US011060519B1

(12) United States Patent
Yang et al.

(10) Patent No.: US 11,060,519 B1
(45) Date of Patent: Jul. 13, 2021

(54) ROTARY FLUID TRANSMISSION DEVICE

(71) Applicants: Gene-Huang Yang, Taichung County (TW); Shun-Ji Yang, Taichung County (TW)

(72) Inventors: Gene-Huang Yang, Taichung County (TW); Shun-Ji Yang, Taichung County (TW)

( * ) Notice: Subject to any disclaimer, the term of this patent is extended or adjusted under 35 U.S.C. 154(b) by 0 days.

(21) Appl. No.: 17/077,521

(22) Filed: Oct. 22, 2020

(30) Foreign Application Priority Data

Jul. 7, 2020 (TW) ..... 10912294.9

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/04*** | (2006.01) |

(Continued)

(52) U.S. Cl.

CPC ..... *F04C 2/045* (2013.01); *F01C 1/045* (2013.01); *F04C 15/0003* (2013.01); *F04C 15/0023* (2013.01); *F04C 15/0065* (2013.01); *F04C 18/045* (2013.01); *F04C 2230/90* (2013.01);

(Continued)

(58) Field of Classification Search

CPC .. F04C 2/045; F04C 15/0003; F04C 15/0023; F04C 15/0065; F04C 18/02; F04C 18/045; F04C 18/32; F04C 23/001; F04C 23/008; F04C 29/0057; F04C 2230/90;

(Continued)

(56) References Cited

U.S. PATENT DOCUMENTS 3,812,828 A * 5/1974 Griffiths ..... F04C 15/0003 418/147

5,011,386 A 4/1991 Güttinger (Continued)

FOREIGN PATENT DOCUMENTS

CN 101160467 A 4/2008

CN 101975165 B 5/2012

(Continued)

OTHER PUBLICATIONS

Search Report dated Aug. 18, 2020 issued in corresponding Taiwan Application No. 109122949 (with English translation).

(Continued)

*Primary Examiner* — Theresa Trieu

(74) *Attorney, Agent, or Firm* — Muncy, Geissler, Olds & Lowe, P.C.

(57) ABSTRACT

A rotary fluid transmission device contains: a rotor, a drive shaft, a first holder, and a second holder. The first holder includes a circular bush and an annular chamber. The rotor includes a C-shaped piston which has an external face and an internal face. In addition, the annular chamber has a first reservoir defined between the internal face and the circular bush, and the annular chamber has a second reservoir defined between the external face and the inner fringe. The circular seat includes two clamp arms, and a respective clamp arm is rotatably engaged with a blade. The blade includes two abutting faces, and the C-shaped piston has two edge faces. The first holder includes two first conduits and two second conduits, the two first conduits are in communication with the first reservoir, and the two second conduits are in communication with the second reservoir.

8 Claims, 6 Drawing Sheets

(51) Int. Cl.
*F04C 18/04* (2006.01)
*F01C 1/04* (2006.01)
*F04C 15/00* (2006.01)

(52) U.S. Cl.
CPC ..... *F04C 2240/56* (2013.01); *F04C 2240/60* (2013.01); *F04C 2240/801* (2013.01)

(58) Field of Classification Search
CPC ..... F04C 2240/56; F04C 2240/60; F04C 2240/801; F01C 1/045
See application file for complete search history.

(56) References Cited

U.S. PATENT DOCUMENTS

| | | | | |
|---|---|---|---|---|
| 5,399,076 | A | 3/1995 | Matsuda et al. | |
| 5,676,533 | A | 10/1997 | Park et al. | |
| 6,676,392 | B1 | 1/2004 | Hwang et al. | |
| 7,553,141 | B2 | 6/2009 | Masuda | |
| 7,563,080 | B2 | 7/2009 | Masuda | |
| 7,594,803 | B2 | 9/2009 | Theodore, Jr. | |
| 7,802,972 | B2 | 9/2010 | Shimizu et al. | |
| 8,936,448 | B2 | 1/2015 | Okamoto et al. | |
| 9,284,958 | B2 | 3/2016 | Inada et al. | |
| 9,309,862 | B2 | 4/2016 | Mehta et al. | |
| 2006/0073051 | A1* | 4/2006 | Hwang | F04C 18/045 418/59 |
| 2006/0073054 | A1* | 4/2006 | Hwang | F04C 18/045 418/59 |
| 2006/0073057 | A1 | 4/2006 | Yoo et al. | |
| 2006/0127258 | A1* | 6/2006 | Hwang | F04C 18/045 418/59 |
| 2006/0127263 | A1* | 6/2006 | Hwang | F04C 18/045 418/59 |

FOREIGN PATENT DOCUMENTS

| | | | | |
|---|---|---|---|---|
| JP | 57008385 | A * | 1/1982 | F04C 2/045 |
| JP | 2005-320927 | A | 11/2005 | |
| TW | 371018 | | 9/1999 | |
| TW | 201307684 | A | 2/2013 | |

OTHER PUBLICATIONS

Office Action dated Aug. 19, 2020 issued in corresponding Taiwan Application No. 109122949 (with English translation).
Decision of Examination dated Sep. 10, 2020 issued in corresponding Taiwan Application No. 109122949 (with English translation).

* cited by examiner

ROTARY FLUID TRANSMISSION DEVICE

FIELD OF THE INVENTION

The present invention relates to a rotary fluid transmission device which operates smoothly.

BACKGROUND OF THE INVENTION

A conventional rotary compressor is disclosed in U.S. Pat. No. 7,563,080B2 and includes a cylinder, a piston, and a pair of bushes, wherein the piston is formed in a C shape and has a groove defined on an outer wall thereof, the pair of bushes are symmetrically fixed in the groove, and a respective bush clamped a blade which is integrally formed with the cylinder, thus supporting the blade. A drive shaft rotates to actuate an outer cylinder and an inner cylinder to swing along a respective bush of the blade, and the blade moves forward and backward in a blade groove, such that the piston contacts with the cylinder on multiple contact points, as shown in FIGS. 3A to 3D, and the outer cylinder and the inner cylinder swing around the drive shaft but not rotate. Accordingly, the outer cylinder, the inner cylinder, and the piston swing to cause malfunction, when the drive shaft rotates.

Another conventional rotary compressor is disclosed in U.S. Pat. No. 9,284,958B2 and contains a cylinder, a piston, and a pair of bushes, wherein the piston is formed in a C shape and has a groove. The pair of bushes are symmetrically formed in the groove and clamp a blade which is integrally formed with the cylinder so as to support the blade. At least one bush has an oil supply passage, a blade-side oil reservoir, and a groove-side oil reservoir, wherein an end of the oil supply passage is connected with the blade-side oil reservoir, the groove-side oil reservoir is formed on a curved surface of the respective bush, and another end of the oil supply passage is communicated with the groove-side oil reservoir, wherein a width of the groove-side oil reservoir is more than a width of the blade-side oil reservoir.

Since the width of the groove-side oil reservoir is more than the width of the blade-side oil reservoir, a force of oils to an inner wall of the groove-side oil reservoir is greater than a force of the oils to an inner wall of the blade-side oil reservoir so that the respective bush is pushed to the blade, and the oils are supplied to the respective bush and the groove, thus avoiding a damage and a lock of the respective bush.

However, when the piston rotates, two sides of the groove rotate with the piston, and the respective bush is driven by the force of the oils to the respective bush so as to contact with the blade and to move linearly along the blade reciprocately, thus causing engagement among the two sides of the groove and the respective bush. When eccentricity between a center of the drive shaft and the piston produces greatly to drive the piston to rotate, the piston hits the respective bush easily, so the conventional air compressor is applicable for an air compressor of small capacity.

The present invention has arisen to mitigate and/or obviate the afore-described disadvantages.

SUMMARY OF THE INVENTION

The primary objective of the present invention is to a rotary fluid transmission device which contains a blade swinging lightly and moving reciprocately to drive the piston to contact with the blade but not stop the blade to rotate, thus operating the rotary fluid transmission device smoothly.

To obtain above-mentioned objective, a rotary fluid transmission device provided by the present invention contains: a rotor, a drive shaft, a first holder, and a second holder.

The first holder is matingly connected with the second holder, the first holder includes a circular bush accommodated therein, and the first holder includes an annular chamber surrounding the circular bush. The rotor includes a C-shaped piston received in and being eccentric to the annular chamber, the drive shaft is configured to drive the C-shaped piston to make an orbiting motion without rotating in the annular chamber, and the C-shaped piston has an external face and an internal face. The external face tangentially contacts with an inner fringe of the annular chamber, and the internal face tangentially contacts with an outer wall of the circular bush, such that the annular chamber has a first reservoir defined between the internal face and the circular bush, and the annular chamber has a second reservoir defined between the external face and the inner fringe.

The first holder is connected with a circular seat which reciprocately swings within an angle range, and the circular seat includes two clamp arms extending into the annular chamber therefrom. A respective clamp arm is rotatably engaged with a blade, and a dotted line passes through a center of the C-shaped piston, a center of the annular chamber, the two clamp arms, and the blade. The center of the annular chamber is defined between the center of the piston and the blade, and the blade includes two abutting faces, a respective abutting face is parallel to the dotted line, and the dotted line passes through the respective abutting face. The C-shaped piston has two edge faces, the two edge faces are located on two ends of the C-shaped piston, and a respective edge face contacts with the respective abutting face, such that the C-shaped piston makes an orbiting motion along the center of the annular chamber, the respective edge face reciprocately slides with respect to the respective abutting face, and the blade moves vertically along the dotted line back and forth, thus operating the rotary fluid transmission device smoothly.

The first holder includes two first conduits and two second conduits, the two first conduits are in communication with the first reservoir and are proximate to two sides of the circular seat, and the two second conduits are in communication with the second reservoir and are adjacent to the two sides of the circular seat, such that fluids flow into and out of the annular chamber.

DETAILED DESCRIPTION OF THE PREFERRED EMBODIMENTS

Figure 1:
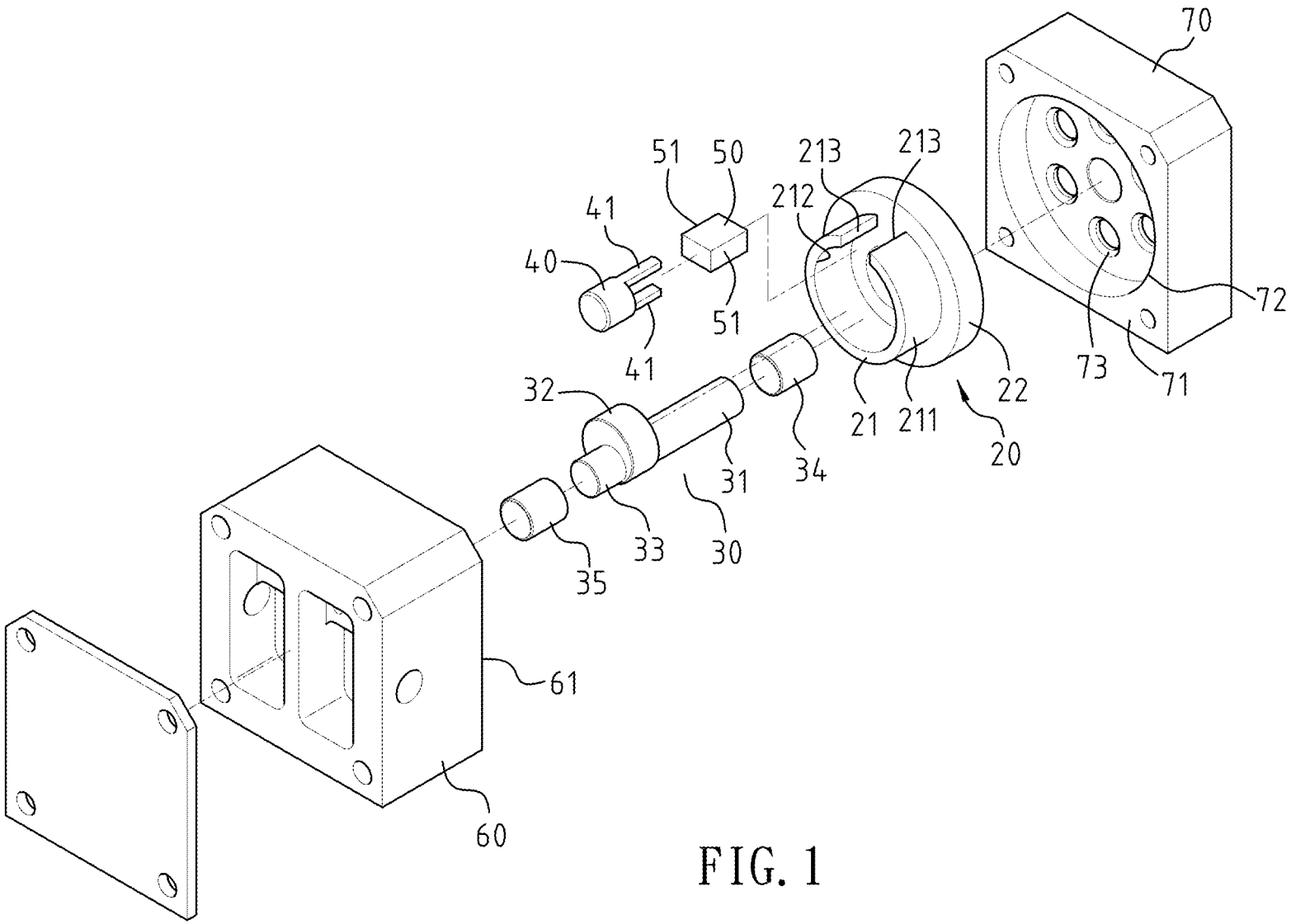
FIG. 1 is a perspective showing the exploded components of a rotary fluid transmission device according to a first embodiment of the present invention.
Figure 2:
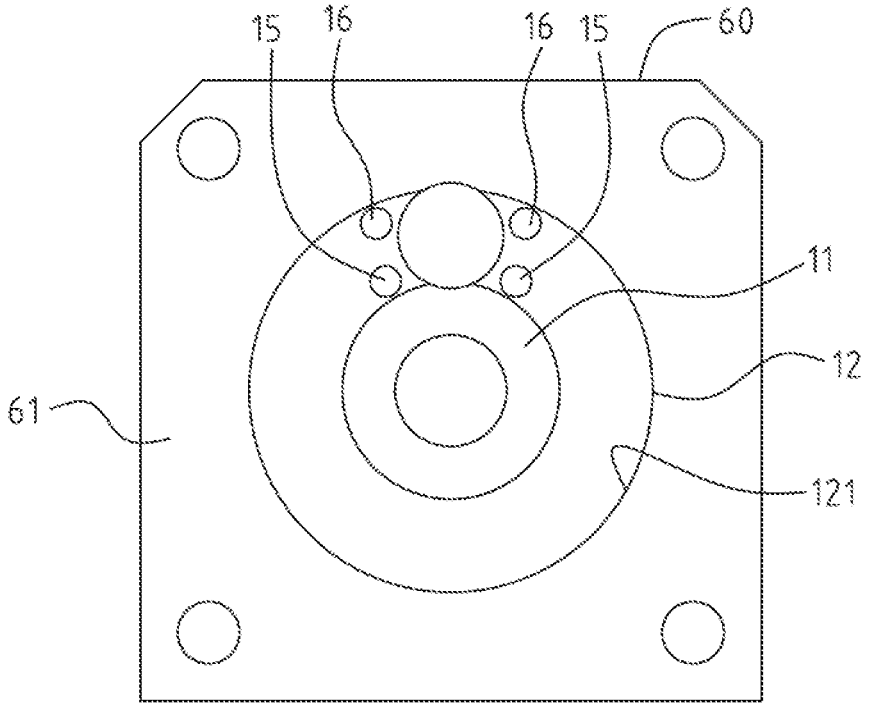
FIG. 2 is a bottom plan view showing the assembly of a part of the rotary fluid transmission device according to the first embodiment of the present invention.
Figure 3:
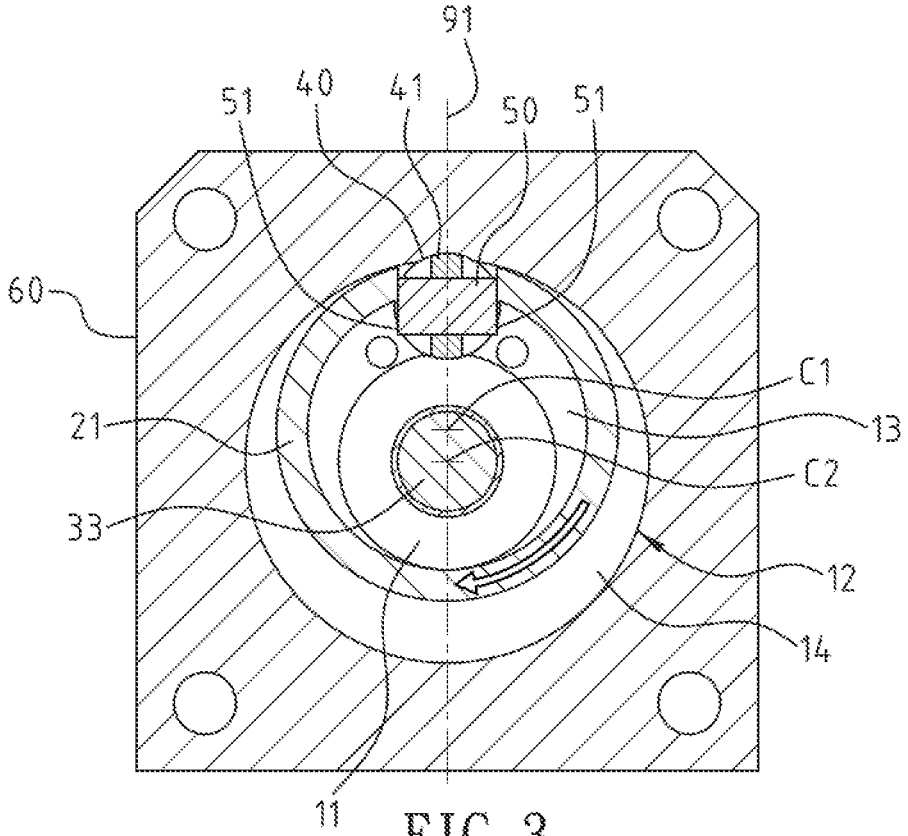
FIG. 3 is a cross sectional view showing the assembly of a part of the rotary fluid transmission device according to the first embodiment of the present invention.
Figure 4:
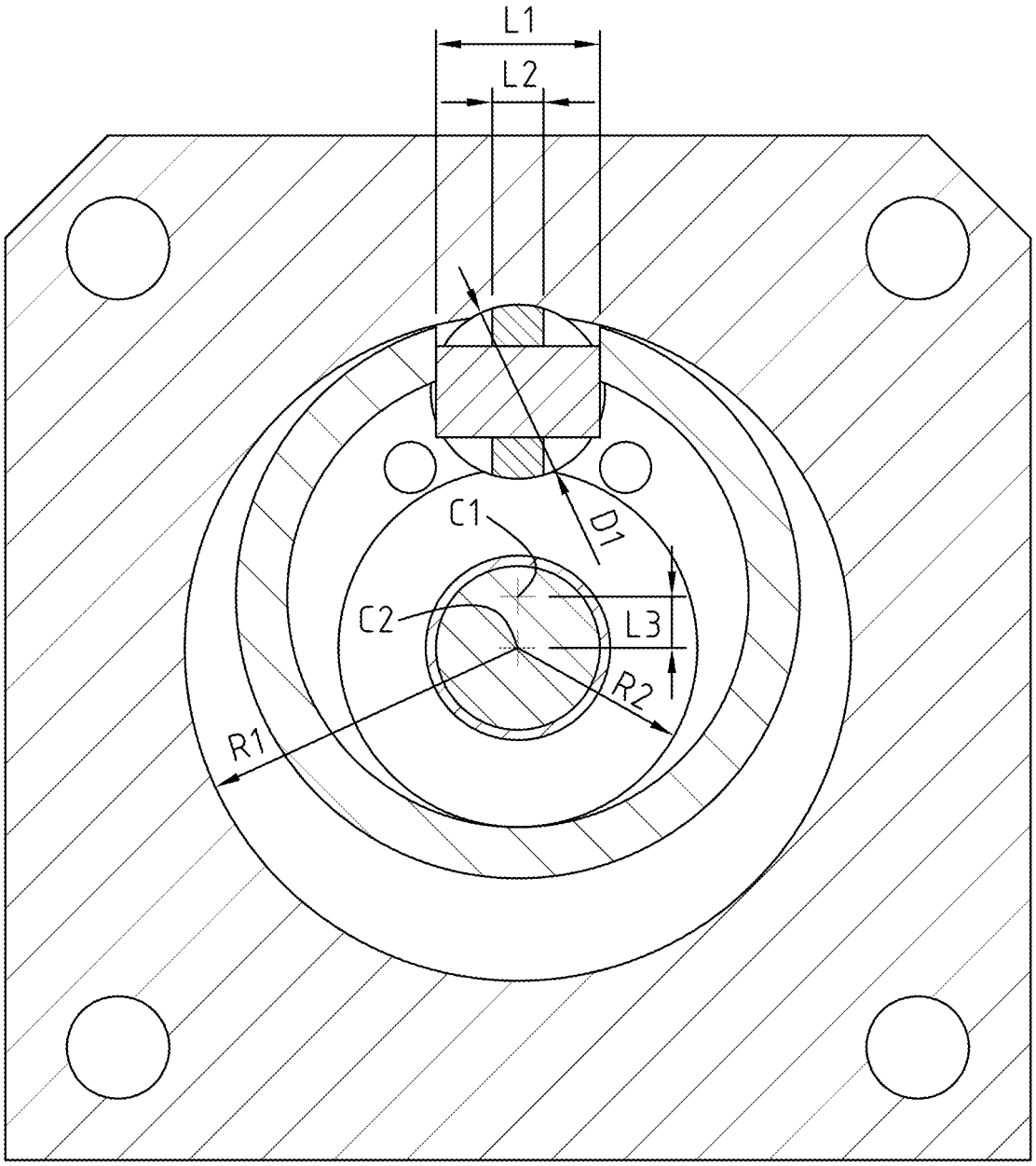
FIG. 4 is another cross sectional view showing the assembly of a part of the rotary fluid transmission device according to the first embodiment of the present invention.

With reference to FIGS. 1-4, a rotary fluid transmission device according to a first embodiment of the present invention comprises: a rotor 20, a drive shaft 30, a first holder 60, and a second holder 70, wherein the first holder 60 is matingly connected with the second holder 70, and the first holder 60 and the second holder 70 are closed by sealant or at least one gasket.

The first holder 60 includes a circular bush 11 accommodated therein and includes an annular chamber 12 surrounding the circular bush 11. The rotor 20 includes a C-shaped piston 21 received in and being eccentric to the annular chamber 12. The drive shaft 3020 is configured to drive the C-shaped piston 21 to make an orbiting motion without rotating in the annular chamber 12, and the C-shaped piston 21 has an external face 211 and an internal face 212, wherein the external face 211 tangentially contacts with an inner fringe 121 of the annular chamber 12, the internal face 212 tangentially contacts with an outer wall of the circular bush 11, such that the first annular chamber 12 has a first reservoir 13 defined between the internal face 212 and the circular bush 11, and the annular chamber 12 has a second reservoir 14 defined between the external face 211 and the inner fringe 121.

The first holder 60 is rotatably connected with a circular seat 40 which reciprocately swings within an angle range, and the circular seat 40 includes two clamp arms 41 extending into the annular chamber 12 therefrom, wherein a respective clamp arm 41 is rotatably engaged with a blade 50, and a dotted line 91 passes through a center C1 of the C-shaped piston 21, a center C2 of the annular chamber 12, the two clamp arms 41, and the blade 50, wherein the center C1 of the C-shaped piston 21 is defined between the center C2 of the annular chamber 12 and the blade 50, and the blade 50 includes two abutting faces 51, a respective abutting face 51 is parallel to the dotted line 91 and the dotted line 91 passes through the respective abutting face 51. The C-shaped piston 21 has two edge faces 213, the two edge faces 213 are located on two ends of the C-shaped piston 21, and a respective edge face 213 contacts with the respective abutting face 51, such that the C-shaped piston 21 makes an orbiting motion without rotating along the center C2 of the annular chamber 12, the respective edge face 213 reciprocately slides with respect to the respective abutting face 51, and the blade 50 moves vertically along the dotted line 91 back and forth, thus operating the rotary fluid transmission device smoothly.

The first holder 60 includes two first conduits 15 and two second conduits 16, wherein the two first conduits 15 are in communication with the first reservoir 13 and are proximate to two sides of the circular seat 40. The two second conduits 16 are in communication with the second reservoir 14 and are adjacent to the two sides of the circular seat 40, such that fluids flow into and out of the annular chamber 12. The two first conduits 15 and the two second conduits 16 are connected with a control valve or a check valve (not shown) so as to control a flowing direction of the fluids.

Figure 5:
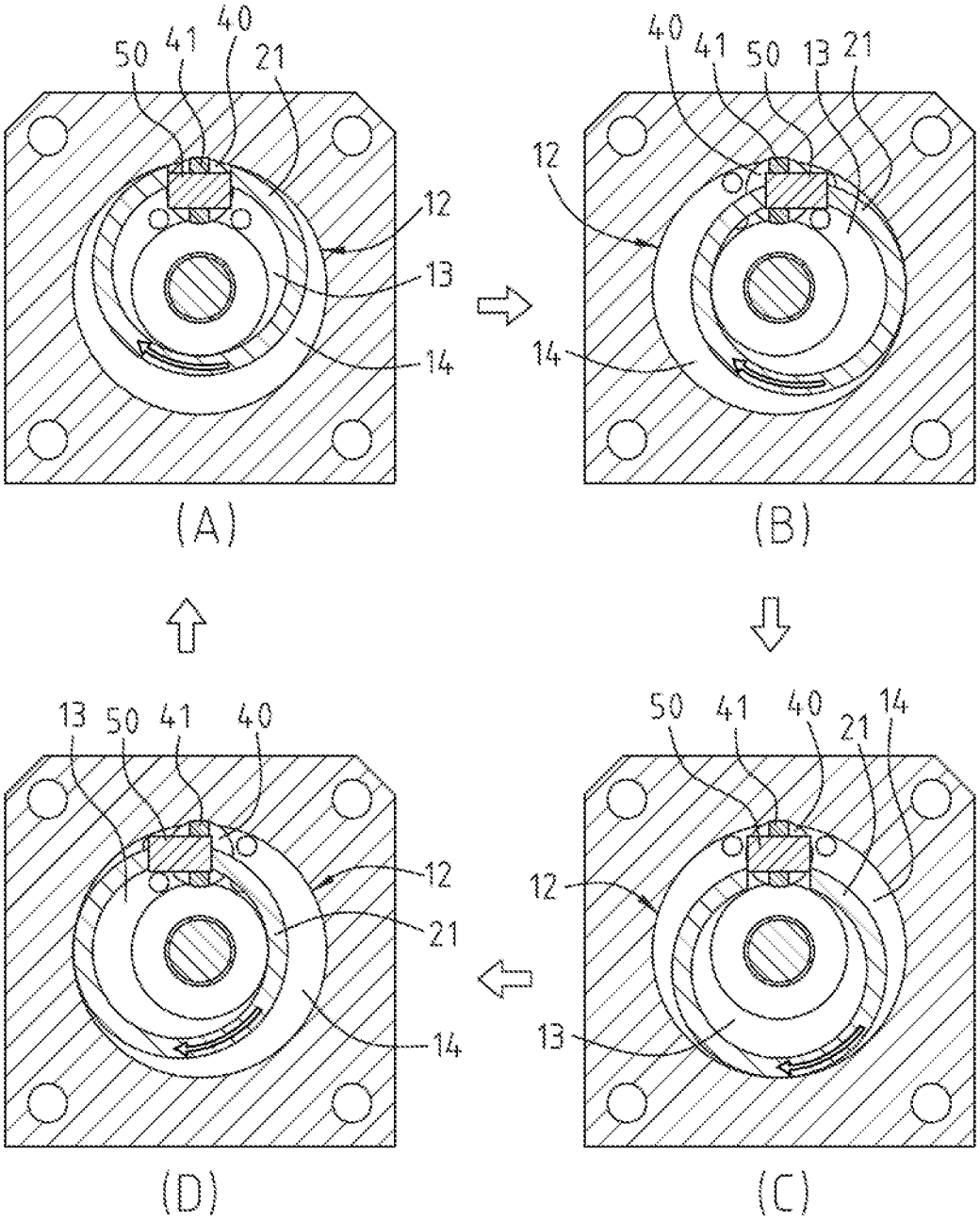
FIG. 5 is a cross sectional view showing the operation of a part of the rotary fluid transmission device according to the first embodiment of the present invention.

Referring to FIG. 5, the drive shaft 30 is driven by a driving device (not shown) to actuates the rotor 20 to make an orbiting motion. The C-shaped piston 21 makes an orbiting motion without rotating in the annular chamber 12 so as to change the first reservoir 13 and the second reservoir 14, such that the fluids flows into or out of the annular chamber 12 via the two first conduits 15 and the two second conduits 16.

The respective edge face 213 contacts with the respective abutting face 51, the blade 50 is acted by the C-shaped piston 21 to move reciprocately, wherein the circular seat 40 is opposite to the blade 50 and is configured to swing the blade 50 lightly, and the blade 50 contacts with the C-shaped piston 21 but does not stop the C-shaped piston 21, thus operating the blade 50 and the C-shaped piston 21 smoothly.

A first length L1 is defined between the blade 50 and the respective abutting face 51, a second length L2 is defined between the respective clamp arm 41 and the respective abutting face 51, and an eccentric distance L3 is defined between the center C1 of the C-shaped piston 21 and the center C2 of the annular chamber 12, wherein $(L2+(2\times L3)) \leq L1$. An outer diameter of the circular seat 40 is designated as D1, a radius of the annular chamber 12 is denoted as R1, and a radius of the circular bush 11 is represented as R2, wherein $(R1-R2) \leq D1$, such that when the C-shaped piston 21 rotates, the blade 50 moves and does not stop when contacting with the C-shaped piston 21, thus delivering the fluids smoothly.

The first holder 60 includes a first plane 61, the second holder 70 includes a second plane 71 opposite to the first plane 61, and the annular chamber 12 is dented from the first plane 61 to the first holder 60, the circular seat 40 is rotatably engaged in the first holder 60, and the second plane 71 has a receiving groove 72 formed therein. The rotor 20 includes a disc 22 which is coaxial with the C-shaped piston 21 and is accommodated in the receiving groove 72, and a side of the disc 22 contacts with the first plane 61 so as to close an end of the second holder 70 adjacent to the annular chamber 12.

The drive shaft 30 includes a first connection section 31, a second connection section 32, and a third connection section 33 which are connected, wherein the second connection section 32 is defined between the first connection section 31 and the third connection section 33, the first connection section 31 is coaxial with the third connection section 33, the second connection section 32 is eccentric to the first connection section 31 and the third connection section 33, wherein the first connection section 31 is rotatably connected with and extends out of the second holder 70 so that the first connection section 31 is connected with the driving device, the second connection section 32 is rotatably connected with a center of the disc 22, the third connection section 33 is rotatably connected with the circular bush 11, such that the driving device drives the rotor 20 to revolve via the drive shaft 30. The driving device is a motor or other devices configured to drive the rotor to make an orbiting motion. Preferably, an oil seal or an O-ring is defined between the first connection section 31 and the second holder 70 so as to achieve a closing effect to the first connection section 31 and the second holder 70.

A first bushing 34 is connected between the first connection section 31 and the second holder 70, and a second bushing 35 is connected with the third connection section 33 and the circular bush 11, wherein the first bushing 34 and the second bushing 35 are made of wear-resistant material so as to prolong a service life of the drive shaft 30 and the rotor 10. In another embodiment, a third bushing (not shown) is connected between the second connection section 32 and the disc 22. In another embodiment, the first bushing 34, the second bushing 35, and the third bushing are replaced by a bearing.

The receiving groove 71 is circular, the disc 22 is circular and is eccentric to the receiving groove 72, and a peripheral side of the disc 22 tangentially contacts with an inner wall of the receiving groove 72.

Figure 6:
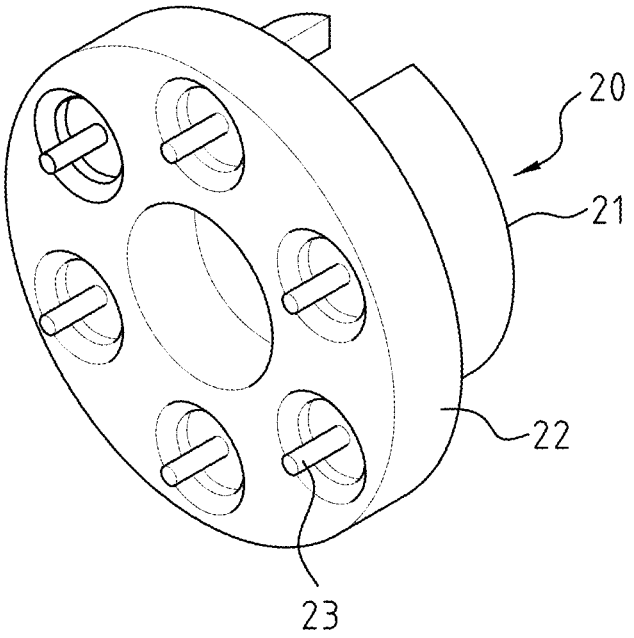
FIG. 6 is a perspective view showing the assembly of a part of the rotary fluid transmission device according to the first embodiment of the present invention.
Figure 7:
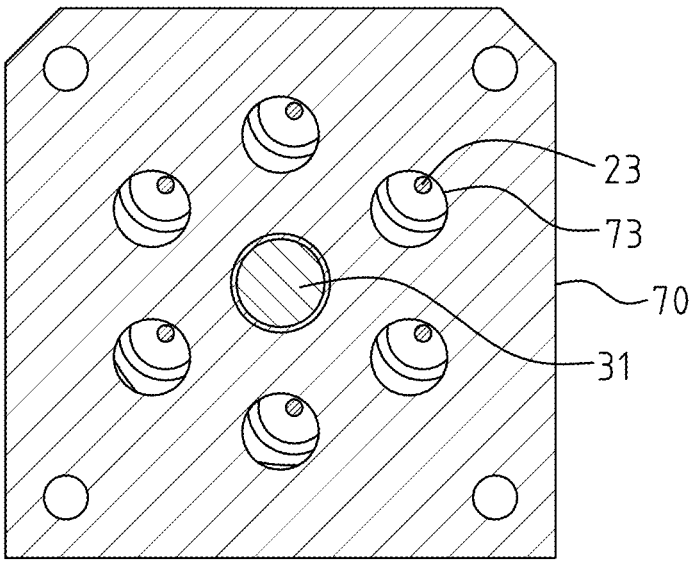
FIG. 7 is also another cross sectional view showing the assembly of a part of the rotary fluid transmission device according to the first embodiment of the present invention.

As illustrated in FIGS. 6 and 7, the receiving groove 72 has multiple cutouts 73 away from the first holder 60, the disc 22 has multiple columns 23 corresponding to the multiple cutouts 73 of the receiving groove 72, wherein an outer diameter of a respective column 23 is less than an inner diameter of a respective cutout 73 so that the respective column 23 is received in and is tangent with the respective cutout 73, such that a movement radius of the disc 22 is limited, and the rotor 20 makes an orbiting motion without rotating.

Figure 8:
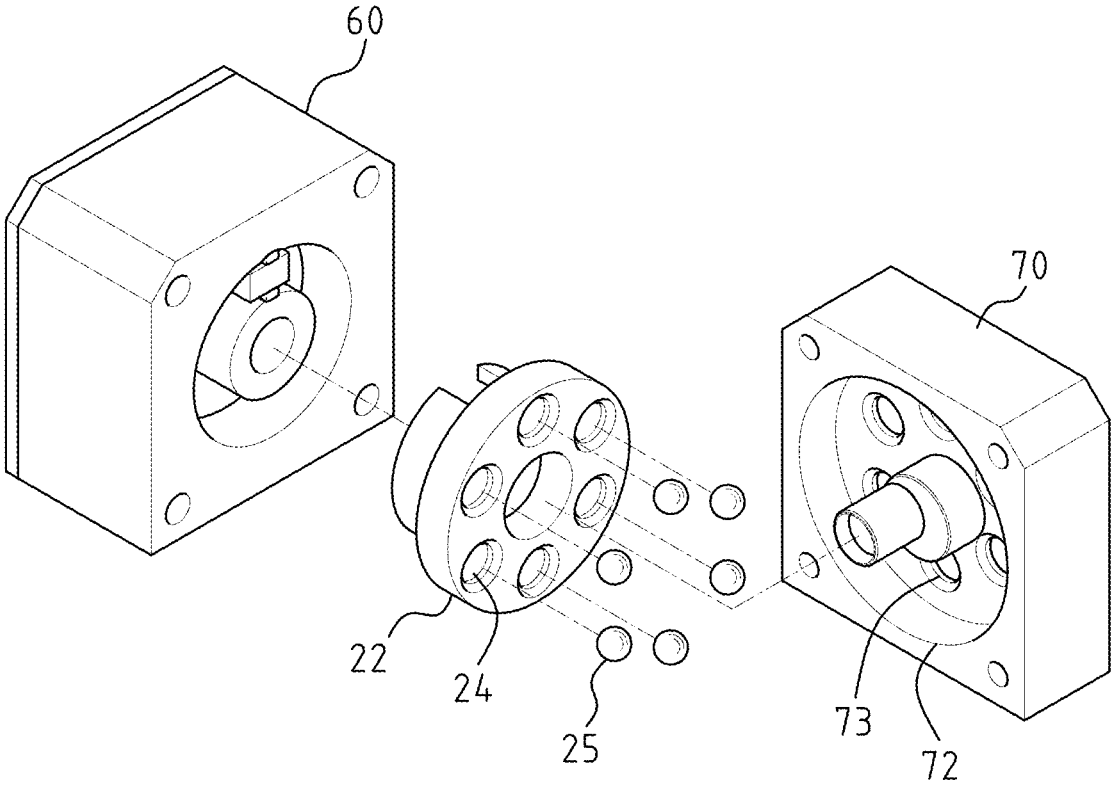
FIG. 8 is a perspective showing the exploded components of a rotary fluid transmission device according to a second embodiment of the present invention.

With reference to FIG. 8, in a second embodiment, no any column 23 of the first embodiment is provided, and the disc 22 has multiple cavities 24 corresponding to the multiple cutouts 73, and the disc 22 has multiple balls 25, wherein a respective ball 25 is received between the respective cutout 73 and a respective cavity 24, and the respective ball 25 contacts with the disc 22 and the second holder 70, thus operating the rotor 20 smoothly.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A rotary fluid transmission device comprising: a rotor, a drive shaft, a first holder, and a second holder;

wherein the first holder is matingly connected with the second holder, the first holder includes a circular bush accommodated therein, and the first holder includes an annular chamber surrounding the circular bush, the rotor includes a C-shaped piston received in and being eccentric to the annular chamber, the drive shaft is configured to drive the C-shaped piston to make an orbiting motion without rotating in the annular chamber, and the C-shaped piston has an external face and an internal face, wherein the external face tangentially contacts with an inner fringe of the annular chamber, and the internal face tangentially contacts with an outer wall of the circular bush, such that the annular chamber has a first reservoir defined between the internal face and the circular bush, and the annular chamber has a second reservoir defined between the external face and the inner fringe;

wherein the first holder is connected with a circular seat which reciprocately swings within an angle range, and the circular seat includes two clamp arms extending into the annular chamber therefrom, wherein a respective clamp arm is rotatably engaged with a blade, and a dotted line passes through a center of the C-shaped piston and a center of the annular chamber, the two clamp arms, and the blade, wherein the center of the C-shaped piston is defined between the center of the annular chamber and the blade, and the blade includes two abutting faces, a respective abutting face is parallel to the dotted line, and the dotted line passes through the respective abutting face, the C-shaped piston has two edge faces, the two edge faces are located on two ends of the C-shaped piston, and a respective edge face contacts with the respective abutting face, such that the C-shaped piston makes an orbiting motion without rotating along the center of the annular chamber, the respective edge face reciprocately slides with respect to the respective abutting face, and the blade moves vertically along the dotted line back and forth, thus operating the rotary fluid transmission device smoothly;

wherein the first holder includes two first conduits and two second conduits, the two first conduits are in communication with the first reservoir and are adjacent to two sides of the circular seat and the inner fringe of the annular chamber, and the two second conduits are in communication with the second reservoir and are adjacent to the two sides of the circular seat and the inner fringe of the annular chamber, such that fluids flow into and out of the annular chamber.

2. The rotary fluid transmission device as claimed in claim 1, wherein a first length L1 is defined between the blade and the respective abutting face, a second length L2 is defined between the respective clamp arm and the respective abutting face, and an eccentric distance L3 is defined between the center of the C-shaped piston and the center of the annular chamber, wherein $(L2+(2\times L3))\leq L1$, an outer diameter of the circular seat is designated as D1, a radius of the annular chamber is denoted as R1, and a radius of the circular bush is represented as R2, wherein $(R1-R2)\leq D1$.

3. The rotary fluid transmission device as claimed in claim 1, wherein the first holder includes a first plane, the second holder includes a second plane opposite to the first plane, and the annular chamber is dented from the first plane to the first holder, the second plane has a receiving groove formed therein, the rotor includes a disc which is coaxial with the C-shaped piston and is accommodated in the receiving groove, and a side of the disc contacts with the first plane so as to close an end of the second holder adjacent to the annular chamber.

4. The rotary fluid transmission device as claimed in claim 3, wherein the drive shaft includes a first connection section, a second connection section, and a third connection section which are connected, the second connection section is defined between the first connection section and the third connection section, the first connection section is coaxial with the third connection section, the second connection section is eccentric to the first connection section and the third connection section, wherein the first connection section is rotatably connected with and extends out of the second holder, the second connection section is rotatably connected with a center of the disc, the third connection section is rotatably connected with the circular bush.

5. The rotary fluid transmission device as claimed in claim 4, wherein a first bushing is connected between the first connection section and the second holder, and a second bushing is connected with the third connection section and the circular bush, wherein the first bushing and the second bushing are made of wear-resistant material.

6. The rotary fluid transmission device as claimed in claim 3, wherein the receiving groove is circular, the disc is circular and is eccentric to the receiving groove, and a peripheral side of the disc tangentially contacts with an inner wall of the receiving groove.

7. The rotary fluid transmission device as claimed in claim 6, wherein the receiving groove has multiple cutouts away from the first holder, the disc has multiple columns corresponding to the multiple cutouts of the receiving groove, wherein an outer diameter of a respective column is less than an inner diameter of a respective cutout so that the respective column is received in and is tangent with the respective cutout, such that a movement radius of the disc is limited, and the rotor makes an orbiting motion without rotating.

8. The rotary fluid transmission device as claimed in claim 6, wherein the receiving groove has multiple cutouts away from the first holder, the disc has multiple cavities corresponding to the multiple cutouts, and the disc has multiple balls, wherein a respective ball is received between the respective cutout and a respective cavity, and the respective ball contacts with the disc and the second holder, thus operating the rotor smoothly.

* * * * *